United States Patent [19]

Sacca et al.

[11] Patent Number: 4,520,867

[45] Date of Patent: Jun. 4, 1985

[54] SINGLE INLET/OUTLET-TANK U-SHAPED TUBE HEAT EXCHANGER

[75] Inventors: Demetrio B. Sacca, Lockport; Edward H. Sanderson; Paul K. Beatenbough, both of Medina, all of N.Y.

[73] Assignee: General Motors Corporation, Detroit, Mich.

[21] Appl. No.: 577,178

[22] Filed: Feb. 6, 1984

[51] Int. Cl.[3] ..... F28F 9/26

[52] U.S. Cl. ..... 165/144; 165/150; 165/151; 165/176

[58] Field of Search ..... 165/150, 151, 176, 144

[56] References Cited

U.S. PATENT DOCUMENTS

| | | | |
|---|---|---|---|
| 1,856,963 | 5/1932 | Martin | 165/176 |
| 2,733,899 | 2/1956 | Lehmann | 165/151 |
| 4,050,881 | 9/1977 | Watson | 165/151 |
| 4,172,496 | 10/1979 | Melnyk | 165/76 |
| 4,446,915 | 5/1984 | Welch et al. | 165/144 |

*Primary Examiner*—William R. Cline

*Assistant Examiner*—John J. McGlew, Jr.

*Attorney, Agent, or Firm*—R. L. Phillips

[57] ABSTRACT

A single inlet/outlet-tank U-shaped tube heat exchanger is disclosed comprising a tank having a header plate and a plurality of U-shaped tubes whose legs extend through and terminate with an open end at one side of the header plate. A first group of the tubes is arranged so that the two open ends of each of these tubes are located in one and the other of two outboard rows extending longitudinally of the header plate. A second and remaining group of the tubes is arranged so that the return bends of these tubes criss-cross those of alternate tubes in the first group and have their open leg ends all located in a third and inboard row extending between the two outboard rows. A partition in the tank cooperates with the header plate to define an inlet chamber and an outlet chamber in the tank open respectively to the open tube ends in one and the other of the two outboard rows and also to alternate ones of the open tube ends in the inboard row whereby each of the tubes is connected to effect two-pass flow between said chambers.

3 Claims, 6 Drawing Figures

SINGLE INLET/OUTLET-TANK U-SHAPED TUBE HEAT EXCHANGER

TECHNICAL FIELD

This invention relates to single inlet/outlet-tank U-shaped tube heat exchangers and more particularly to those employing two rows of U-shaped tubes wherein each tube provides two-pass flow between the inlet and outlet.

BACKGROUND OF THE INVENTION

In heat exchangers of the above type, it is common practice where there are height and/or width limitations to increase the heat transfer capacity of a single tube row arrangement by simply adding an additional row of tubes. But this normally adds substantially to the core depth even where the tubes are arranged to overlap since each tube has two legs whose open ends are typically arranged in separate rows to make connection at a header plate with the inlet and outlet chambers in the tank for the two-pass flow by each tube. Moreover, the tank including the header plate must then also be increased in size depthwise to accommodate the additional row of tubes. This can present a substantial limitation particularly where the existing packaging space requirements do not permit the resulting increases in size.

For example, in the use of such a heat exchanger as a heater core in the passenger heating system of an automotive vehicle, the typical heater core with one row of U-shaped tubes may be found to lack sufficient heat capacity in a more demanding application so that an additional row is required. But with two rows of U-shaped tubes, there are normally four rows of tube legs that must be accommodated across the thickness or depth of the core and make connection at the header plate with the inlet and outlet chambers in the tank. However, the resulting increase in core depth even where the tubes are arranged to overlap sideways, may not be possible within the confined space of the existing heater case thereby also requiring accommodating alterations in the latter provided such is possible within its space restraints in the vehicle. Moreover, where the heat exchanger is of the tube and fin type, this requires an accompanying increase in the depth of the fins as well as the tank and header plate.

SUMMARY OF THE INVENTION

The present invention allows the addition of a second row of U-shaped tubes in a manner such that all the tube legs can be arranged in just three rows so as not to require any increase in core depth but still each provide two-pass flow between the inlet and outlet of the tank. This is accomplished by arranging a first group of the U-shaped tubes in conventional manner so that their two open leg ends are located in one and the other of two longitudinally extending outboard rows at the header plate. A second and remaining group of the tube necessary to give the required heat transfer capacity are then arranged so as to have their return bends criss-cross with those of alternate tubes in the first group with the open leg ends in the second group all located in a longitudinally extending inboard row at the header plate intermediate the two outboard rows, i.e. in an otherwise unused space in the core between the legs of the tubes in a single row arrangement. The single inlet/-outlet-tank is then provided with a corrugated partition that cooperates with the header plate to divide the interior of the tank into an inlet chamber and an outlet chamber which are open respectively to the open leg ends in one and the other of the two outboard rows and are also open to alternate ones of the open leg ends of the tubes in the inboard row. And thus the open tube legs ends in all three rows are open in the respective inlet chamber and outlet chamber so as to effect two-pass flow by each of the U-shaped tubes between the chambers. The resulting three-row deep U-shaped tube arrangement thus does not require any more core depth than that of a single row of U-shaped tubes thereby minimizing the depth of the core in gaining the additional heating capacity.

These and other objects, advantages and features of the present invention will become more apparent from the following description and drawing in which:

Figure 1:
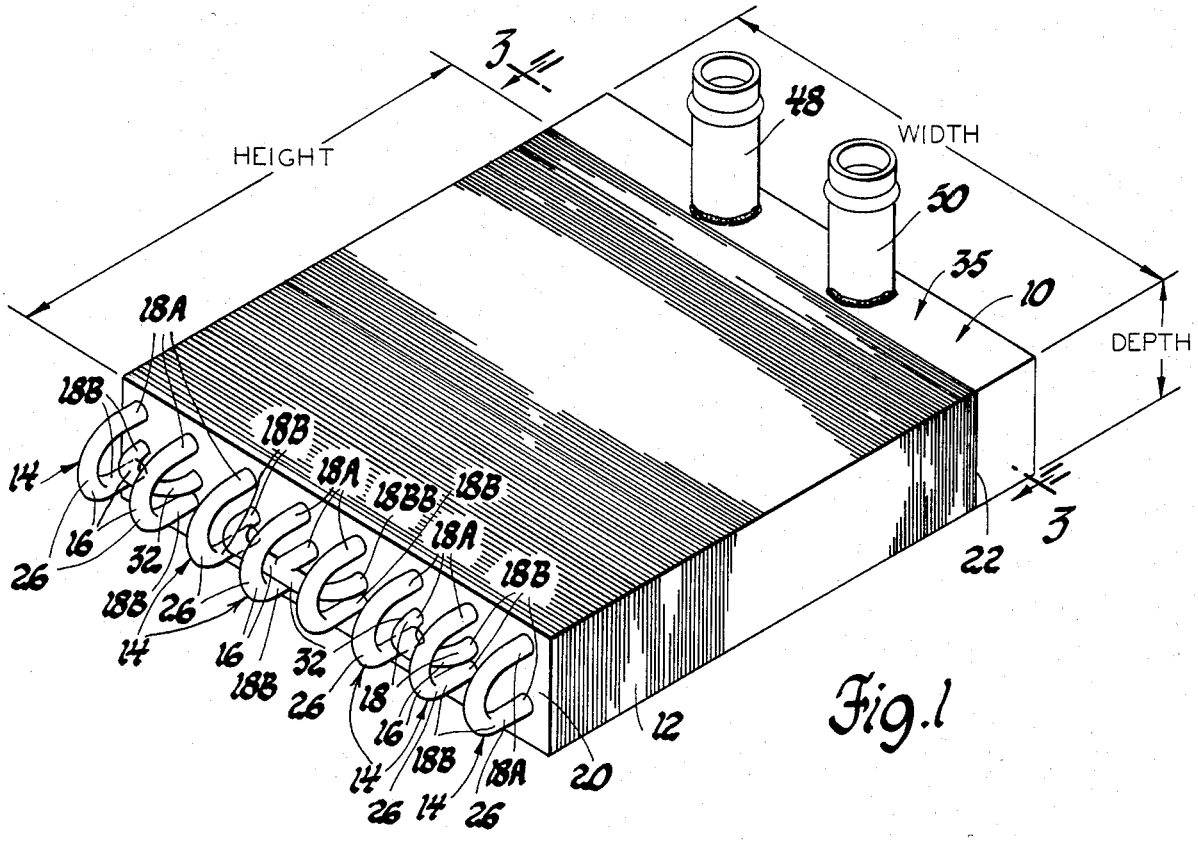
FIG. 1 is an isometric view of one embodiment of a heat exchanger having a tube arrangement and inlet/-outlet-tank constructed according to the present invention.
Figure 2:
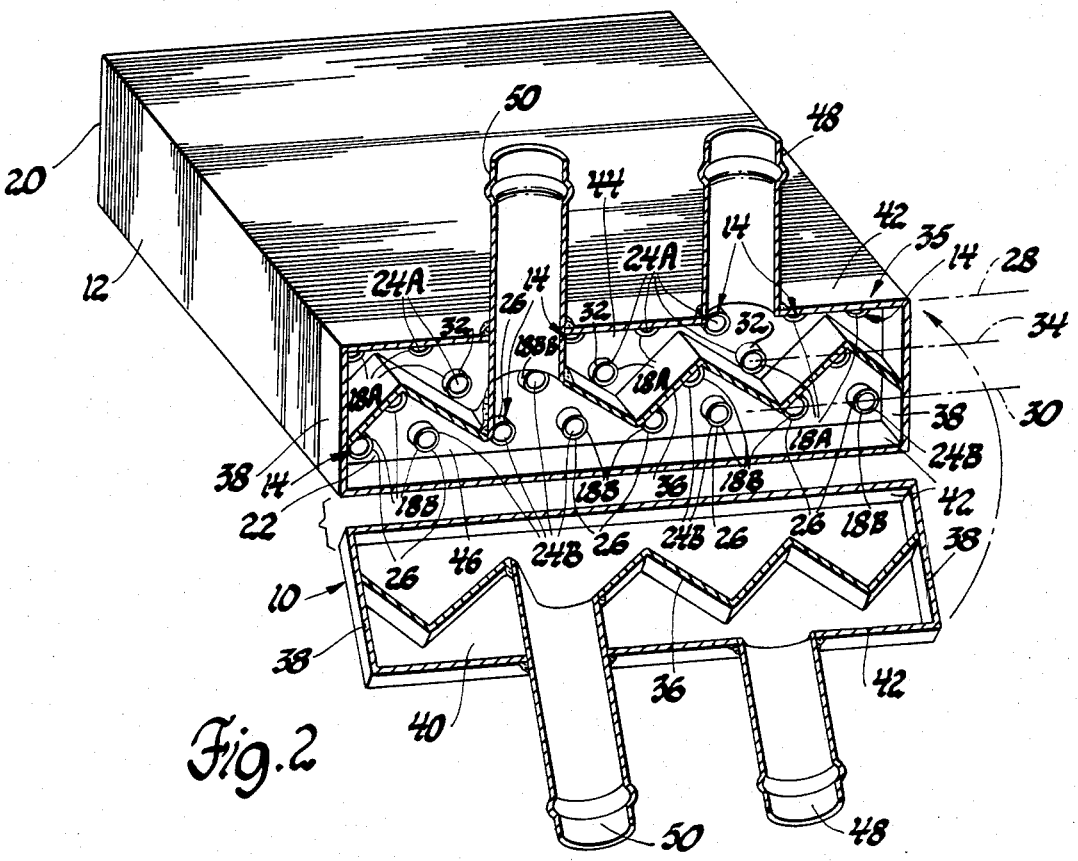
FIG. 2 is another isometric view of the heat exchanger in FIG. 1 with the inlet/outlet-tank broken and tilted away to expose the interior.
Figure 3:
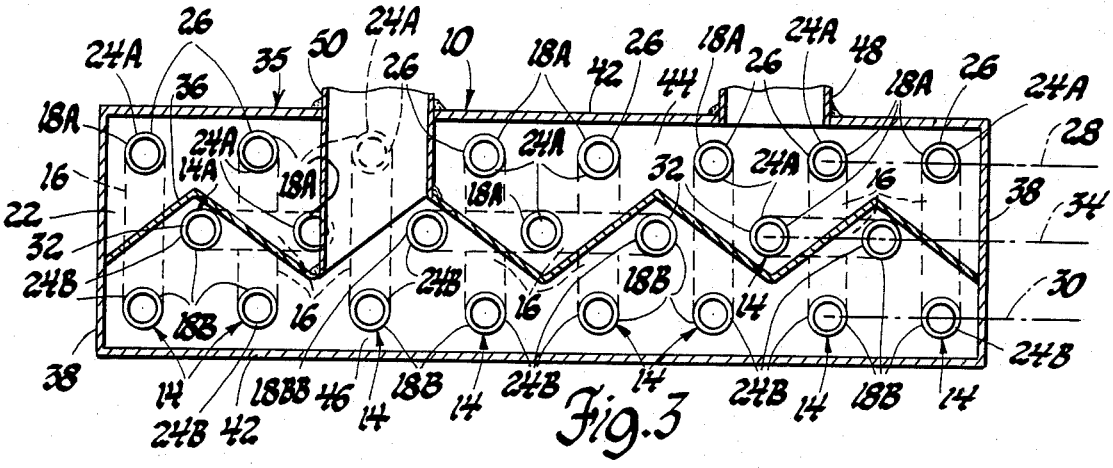
FIG. 3 is an enlarged sectional view taken along the line 3—3 in FIG. 1.

Referring to the drawings, the heat exchanger shown in FIGS. 1–3 is of brazed aluminum and is adapted for use as a heater core in the passenger heating system of an automotive vehicle. The heat exchanger is of the tube and fin type and basically comprises an inlet/outlet-tank 10, a plurality of fins 12 and a plurality of U-shaped tubes 14 also called hairpins. The tubes 14 each have a return bend 16 and a pair of parallel legs 18A, 18B with the latter extending from their return bend through an end plate 20, the fins 12 and thence through a header plate 22 which forms the bottom of the tank 10. Each tube leg 18A, 18B is sealingly secured to the header plate and terminates with an open end 24A, 24B respectively at one side of the header plate so as to be open to the interior of the tank.

The tubes in the group identified as 26 have their return bends 16 arranged parallel to each other at right angles to the core width and are equally spaced across the latter so as to have their open ends 24A and 24B located in two parallel outboard rows 28 and 30 extending longitudinally and adjacent the edge of the header plate 22 as best seen in FIGS. 2 and 3. On the other hand, the remaining tubes identified as group 32 have their return bends 16 aligned with each other across the width of the core so as to criss-cross with the return bends in the other group 26. In the arrangement shown, the return bends in group 32 are located inward of those in the other group 26; however, it will be understood that this underpass relationship of group 32 could be reversed to that of an overpass as will become more apparent later. This criss-crossing of the return bends permits the tubes in group 32 with shortening of their legs because of their underpass arrangement to have their open ends 24A, 24B all located in a third and inboard row 34 extending along the length of the header plate 22 intermediate and parallel to the two outboard rows 28 and 30. In the heater core shown and to meet a particular passenger heating capacity requirement, it was determined that with eight (8) tubes in the group 26 occupying the width of the core, an additional three (3) tubes was required in the group 32 to obtain the necessary additional heat capacity noting that the intermediate tube in the latter group is formed as a double-U-shaped tube having an additional third leg 18BB with an open end 24B in the inboard row 34 for purposes of two-pass connection of this tube with the tank as will become more apparent later.

The inlet/outlet-tank 10 is formed by the header plate 22 and a five-sided rectangular shaped box 35 which is adapted to be sealingly fixed along the perimeter of the open side thereof to a corresponding edge of the header plate to thereby completely enclose the side of the header plate having the open tube ends 24A, 24B. In addition, there is provided a corrugated partition 36 which is sealingly secured along its perimeter to the interior of the tank at the two ends 38 and the top 40 of the box 35 and the interior side of the header plate 22. The partition 36 extends the length of the tank (i.e. the width of the core) midway between the two sides 42 thereof and joins with the ends 38 so as to divide the interior of the tank into a pair of chambers 44 and 46 which are connected with the heating system by pipes 48 and 50. The pipe 48 extends through and is sealingly connected to one of the walls 42 so as to directly connect with the chamber 44 while the other pipe 50 extends through and is sealingly connected to the same tank wall and the partition 36 so as to connect with the other chamber 46, the latter pipe thus also extending through the chamber 44. Depending upon the installation of the heater core, the pipes 48 and 50 may be alternately used as either the inlet or outlet connection for delivering liquid to and from the heat exchanger core.

As shown in FIGS. 2 and 3, the corrugated partition 36 has a saw-tooth wave-shape with respect to the open tube or leg ends 24A and 24B of the tubes in group 32 that occupy the inboard row 34 so that it weaves or zig-zags between these open tube ends in a manner such that the tank chambers 44 and 46 are open respectively to the open leg ends 24A and 24B in the respective outboard rows 28 and 30 and are also open to alternate ones of the open leg ends in the inboard row 34 so that the open leg ends 24A and 24B in the latter row are also open to the respect chambers 44 and 46. As a result, the open leg ends 24A and 24B in all three rows are open to the respective chambers 44 and 46 and thus to the inlet and outlet connections with the heater core so that each tube thus provides two-pass flow between the inlet and outlet. Furthermore, it will be appreciated that the intermediate tube in group 32 with its additional third leg 18BB thus provides continuity in such distribution though with less flow capacity in this particular pass.

And thus though an additional row of U-shaped tubes has been added to what might be considered a conventional single row arrangement, the inboard or intermediate location of the additional tubes results in just three rows of open tube ends which with the simple addition of the corrugated partition maintains two-pass flow with all the return bent tubes separately interconnecting the inlet and outlet chambers of the tank. This intermediate location of the tubes comprising group 32 is thus in what would normally be an unused space in the core and therefore does not require any increase in core depth or size of the tank including the header plate. Furthermore, it will be appreciated that the return bends of the tubes in group 32 could be outside of rather than inside of those in the other group 26 in which case the legs of the tubes in the former group would be lengthened rather than shortened to accommodate their installation. And it will also be appreciated that the heat exchanger with or without fins is adaptive to other uses.

Figure 4:
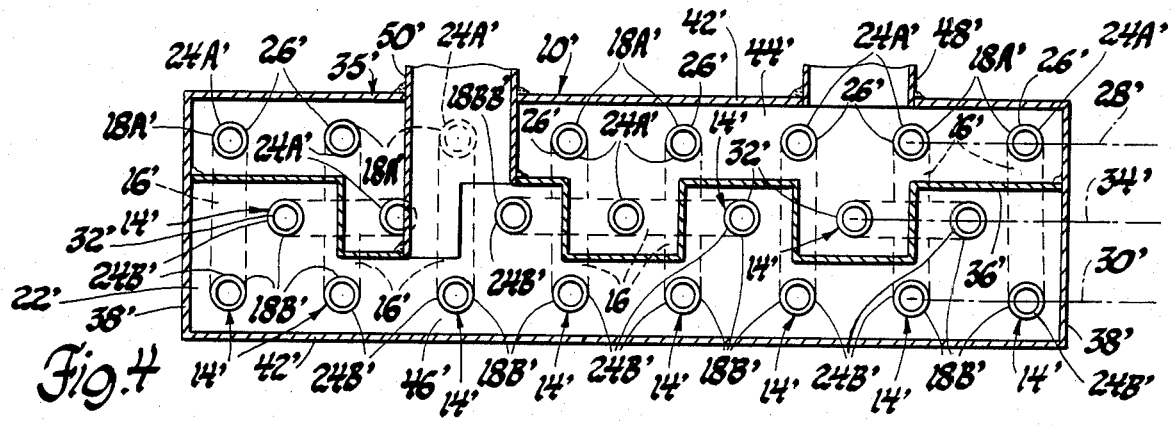
FIG. 4 is a view similar to FIG. 3 but showing another embodiment of the partition in the inlet/outlet-tank.

Another embodiment of the partition is shown in FIG. 4 wherein parts corresponding to those in FIGS. 1–3 are identified by the same numbers only primed. In this case, the same flow pattern is maintained but now by providing the corrugated partition 36' with a right-angle step-shaped form which weaves or zig-zags around the open tube leg ends in the inboard row 34' so as to connect the open end 24A' of each and every tube with chamber 44' and the other open end 24B' of each and every tube with the other chamber 46'.

Figure 5:
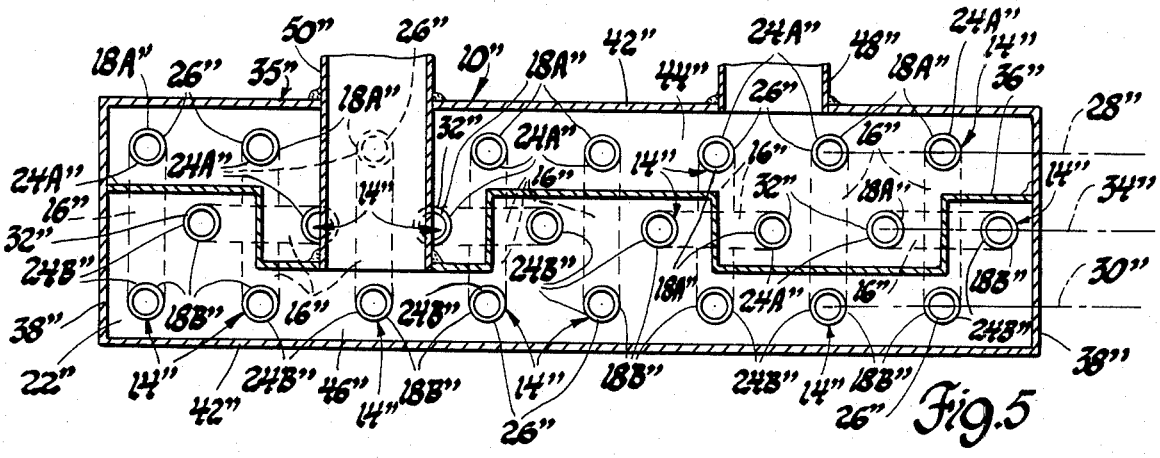
FIG. 5 is a view similar to FIG. 3 but showing another embodiment of both the tube arrangement and the partition in the inlet/outlet-tank.

It is also possible to provide a complete two-pass flow arrangement without a three-legged tube in the inboard row and this is shown in FIG. 5 wherein parts similar to those in the FIGS. 1–3 embodiment are identified by the same numbers only double-primed. It will be recalled that in the FIGS. 1–3 embodiment, only three U-shaped tubes are employed in the added group 32 but with the intermediate tube having the third leg. In the FIG. 5 embodiment, such third leg is eliminated and another U-shaped tube 14'' is simply added to the group 32'' in the inboard row 34' which slightly increases the core width but again not the depth. The corrugated partition 36'' has a right-angle step-shaped corrugation like in the FIG. 4 embodiment but now the intermediate steps are relatively longer so as to weave between the open ends of the tube legs in the inboard row 34'' such that all of the U-shaped tubes 14'' each have their one open leg end 24A'' connected to the tank chamber 44'' and their other open leg end 24B'' connected to the other tank chamber 46''.

Figure 6:
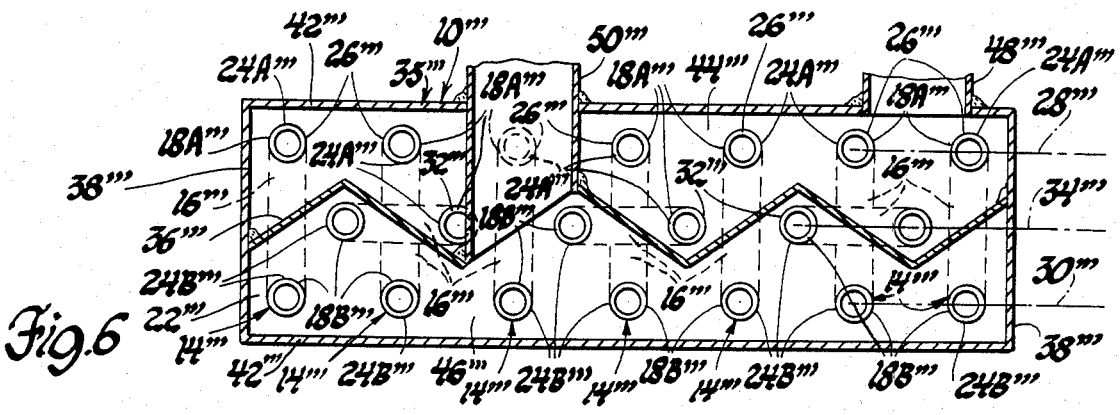
FIG. 6 is a view similar to FIG. 3 but showing another embodiment of both the tube arrangement and the partition in the inlet/outlet-tank.

A still further embodiment utilizing U-shaped tubes without any third leg is shown in FIG. 6 wherein parts similar to those previously described are identified by the same numbers only triple-primed. In this case, there is one less U-shaped tube 14''' in the group 26''' (i.e. an odd number of seven) so that three U-shaped tubes in the other group 32''' can then be arranged to criss-cross at their return bends 16''' with those of every alternate tube in the former group without the addition of a third leg to any tube in the inboard row 34'''. The partition 36''' has a saw-tooth corrugated shape like in the FIG. 3 embodiment but now weaves between each pair of the open tube leg ends 18A''' and 18B''' of group 26''' in the inboard row 34''' to establish two-pass connection of all the U-shaped tubes with the chambers 44''' and 46''' of the tank.

While the above constructions are preferred, it will be appreciated, of course, that more or less tubes may be employed after the above manner depending upon the heat capacity required for a particular application. Furthermore, the shape of the partition may obviously take other forms in providing the two-pass connections taught above.

The above described preferred embodiments are thus illustrative of the invention which may be modified within the scope of the appended claims.

The embodiments of the invention in which an exclusive property or privilege is claimed are defined as follows:

1. A heat exchanger comprising a tank having a header plate, a plurality of tubes each having at least two legs joined by a return bend, the legs of said tubes extending through and terminating with an open end at one side of said header plate, a first group of said tubes being arranged so as to each have their two open ends located in one and the other of two outboard rows extending longitudinally of said header plate, a second and remaining group of said tubes being arranged with their return bends criss-crossing those of alternate tubes in said first group and their open ends all located in a third and inboard row extending between said two outboard rows, and partition means in said tank for cooperating with said header plate to define an inlet chamber and an outlet chamber in said tank open respectively to the open tube ends in one and the other of said two outboard rows and also to alternate ones of the open tube ends in said inboard row whereby each said tube is connected to effect two-pass flow between said chambers.

2. A heat exchanger comprising a tank having a header plate, a plurality of U-shaped tubes each having a pair of legs joined by a return bend, the legs of said tubes extending through and terminating with an open end at one side of said header plate, a first group of said tubes being arranged so as to each have their two open ends located in one and the other of two outboard rows extending longitudinally of said header plate, a second and remaining group of said tubes being arranged with their return bends criss-crossing those of alternate tubes in said first group and their open ends all located in a third and inboard row extending between said two outboard rows, and partition means in said tank for weaving between the open tube ends in said inboard row so as to cooperate with said header plate to define an inlet chamber and an outlet chamber in said tank open respectively to the open tube ends in one and the other of said two outboard rows and also to alternate ones of the open tube ends in said inboard row whereby each said tube is connected to effect two-pass flow between said chambers.

3. A heat exchanger comprising a tank having a header plate, a plurality of U-shaped tubes each having a pair of legs joined by a return bend, the legs of said tubes extending through and terminating with an open end at one side of said header plate, a first group of said tubes being arranged so as to each have their two open ends located in one and the other of two outboard rows extending longitudinally of said header plate, a second and remaining group of said tubes lesser in number than said first group being arranged with their return bends criss-crossing those of alternate tubes in said first group and their open ends all located in a third and inboard row extending between said two outboard rows, and corrugated partition means in said tank for cooperating with said header plate to define an inlet chamber and an outlet chamber in said tank open respectively to the open tube ends one and the other of said two outboard rows and also to alternate ones of the open tube ends in said inboard row whereby each said tube is connected to effect two-pass flow between said chambers.

* * * * *